US005459563A

United States Patent [19]

Fuma et al.

[11] Patent Number: 5,459,563

[45] Date of Patent: Oct. 17, 1995

[54] METHOD OF FORMING A MULTICOLOR TONER IMAGE ON A PHOTORECEPTOR AND TRANSFERRING THE FORMED IMAGE TO A RECORDING SHEET

[75] Inventors: Hiroshi Fuma; Hisahiro Saitou; Mikihiko Takada, all of Hachioji, Japan

[73] Assignee: Konica Corporation, Japan

[21] Appl. No.: 326,052

[22] Filed: Oct. 19, 1994

Related U.S. Application Data

[63] Continuation of Ser. No. 29,016, Mar. 10, 1993, abandoned.

[30] Foreign Application Priority Data

Mar. 27, 1992 [JP] Japan ..... 4-071317
Apr. 1, 1992 [JP] Japan ..... 4-079922

[51] Int. Cl.[6] ..... G03G 15/01; G03G 15/14; G03G 15/06

[52] U.S. Cl. ..... 355/326 R; 355/245; 355/273; 430/54

[58] Field of Search ..... 355/326 R, 219, 355/327, 233, 245, 273; 430/54, 137; 347/115, 117, 232, 233

[56] References Cited

U.S. PATENT DOCUMENTS 5,126,795 6/1992 Maruyama et al. ..... 355/326 X
5,160,969 11/1992 Mizuma et al. ..... 355/245 X
5,204,716 4/1993 Kasahara et al. ..... 355/326 X

FOREIGN PATENT DOCUMENTS 59-116763 7/1984 Japan .
60-166967 8/1985 Japan .

*Primary Examiner*—A. T. Grimley
*Assistant Examiner*—Shuk Y. Lee
*Attorney, Agent, or Firm*—Bierman and Muserlian

[57] ABSTRACT

An image forming machine such as a copier or a printer for forming a multi-color toner image on a photoreceptor. The machine includes: a charger for charging the photoreceptor; an exposer for forming a latent image onto the photoreceptor; plural developers for developing the latent image on the photoreceptor with one of plural different color toners so that the toner image of one of the plural color toners is obtained; in which plural toner images, each of which is formed by one of the plural developers, are superimposed so that a multi-color toner image is formed on the photoreceptor; a re-exposer to re-exposing the multi-color toner image on the photoreceptor; a transferrer for transferring the multi-color toner image onto a recording sheet; in which the transferrer presses the recording sheet onto the photoreceptor for transferring the multi-color toner image from the photoreceptor to the recording sheet; and a cleaner for removing a residual toner on the photoreceptor after the transfer of the multi-color toner image onto the recording sheet; in which the cleaner is brought into contact with the photoreceptor for cleaning the residual toner. In the image forming machine, at least one of the transferrer and the cleaner starts functioning after re-exposing by the re-exposer is completed.

5 Claims, 6 Drawing Sheets

METHOD OF FORMING A MULTICOLOR TONER IMAGE ON A PHOTORECEPTOR AND TRANSFERRING THE FORMED IMAGE TO A RECORDING SHEET

This application is a continuation, of application number 08/029,016, filed Mar. 10, 1993, now abandoned.

BACKGROUND OF THE INVENTION

The present invention relates to an image forming apparatus such as an electrophotographic copying apparatus, and especially to an image forming apparatus by which a multi-color image can be obtained by transferring toner images onto a transfer sheet after toner images have been superimposed on an image carrier.

Conventionally, for example, the following method has been proposed and practiced in order to form multi-color images by an electrophotographic method: image forming processes of charging, exposing, and developing are repeated at each component color; each color toner image is superimposed onto an image carrier; and after that, the multi-color toner image is transferred onto a transfer sheet.

The principle of the image forming method will be explained as follows referring to a flow chart in FIG. 5. FIG. 5 shows changes of the surface potential of a photoreceptor which is an image carrier, and the charged polarity of which is negative.

The photoreceptor is uniformly charged by a scorotron charger, and given a predetermined negative surface potential $V_H$. The surface potential $V_H$ is lowered to $V_L$, close to a zero potential, by a first image exposure using an exposure source such as a laser, a cathode ray tube, a liquid crystal shutter, or an LED.

When the image is developed by a developing means upon which a negative bias voltage, a DC component of which is almost equal to the surface potential $V_H$ of an unexposed portion, is impressed, negatively charged toner T in the developing means sticks to a relatively low potential exposed portion. In this case, the lower the potential is, the larger the stuck amount is. Due to the foregoing, a first color visual image is formed.

Potential of the area on which the visual image has been formed is increased when negatively charged toner T has been stuck onto the area. Next, when second charging is performed, the potential is increased, and the same initial surface potential $V_H$ as that of the unexposed portion is obtained.

Next, a second image exposure is performed on the surface of the photoreceptor on which the uniform surface potential $V_H$ has been obtained, and an electrostatic latent image is formed thereon. Then, the second color visual image is obtained after the same developing operation as the foregoing.

When the above-described processes are repeated, the multi-color toner image can be obtained on the photoreceptor. Only the image portion, which is developed with toner T, is re-exposed so that inferior transferring such as transfer repelling does not occur and excellent transferring can be performed, even when voltage resistance of the transfer sheet is lowered due to high humidity. After that, the multi-color toner image is transferred onto the transfer sheet by a transfer means, and further heated or pressurized to be fixed, so that the multi-color image can be obtained.

In the image forming apparatus by which a multi-color image is obtained according to the foregoing method, a plurality of developing devices are provided around the photoreceptor so that toner images are superimposed on the photoreceptor. Therefore, the diameter of the photoreceptor drum becomes large, and separability of the transfer sheet is deteriorated. Accordingly, sufficient separability can not be obtained by the conventional electrostatic transfer separation type of apparatus. Due to the foregoing, a more positive separation means is necessary. In apparatuses of the type in which the toner image is superimposed, an amount of stuck toner is increased, and a large transfer charge amount is necessary. Accordingly, a transfer belt apparatus is used which has a large transfer charge holding property and excellent separability.

In the above-described multi-color image forming method, a reversal developing method is used as a developing method for an electrostatic latent image. In the reversal developing method, only a toner image forming portion on the photoreceptor is exposed, and since it is not necessary to expose all the background portion as in the case of regular development, the load onto the photoreceptor can be decreased.

Further, by the charging operation for the second time or after, the potential of the visual image which has been formed before charging becomes $V_H$, and the image is not developed if the image is not written again, so that mixing color deteriorations do not occur, which is an advantage of the reversal developing method.

In the image forming apparatus for multi-color images, when a transfer belt apparatus and a cleaning apparatus, are pressed onto the photoreceptor drum during the above-described re-exposure, traveling speed of the photoreceptor drum is drastically changed because of the load onto the photoreceptor. Due to this, a re-exposure position is shifted as shown in FIG. 6(*b*). Therefore, there are problems that: a low potential portion is generated near the toner image; toner T is moved as shown in FIG. 6(*c*); and resolution is lowered and color offset is caused due to splashing of toner T. Further, there are problems that the potential of the finally formed toner image portion is excessively lowered when the re-exposure is performed, and therefore, the transfer ratio is lowered. The first object of the present invention is to provide an image forming apparatus in which re-exposure is performed at a correct position, and resolution is not lowered and color offset is not caused. Further, the second object of the present invention is to provide an image forming apparatus in which toner is not splashed, and a high transfer ratio can be obtained.

SUMMARY OF THE INVENTION

The first object of the present invention is accomplished by an image forming apparatus in which: charging, image exposing, and developing are repeatedly performed so that a multi-color toner image is formed by superimposing toner images onto an image carrier; an image portion which has been already formed is re-exposed after the final toner image has been formed; and after that, the multi-color toner image is transferred onto a transfer sheet by a transfer means. The image forming apparatus comprising the transfer means and a cleaning means, at least one of which is operated after the re-exposure operation is completed.

The second object of the present invention is accomplished by an image forming apparatus in which: charging, image exposing, and developing are repeatedly performed so that a multi-color toner image is formed by superimposing toner images onto an image carrier; an image portion which has been already formed is re-exposed after the final toner image has been formed; and after that, the multi-color toner image is transferred onto a transfer sheet by a transfer means. The image forming apparatus being characterized in that the last color toner image portion is excluded to be re-exposed, and the image carrier is not re-charged after the multi-color toner image is formed.

DETAILED DESCRIPTION OF THE INVENTION

The structure and operation of the embodiment will be explained as follows. In this explanation, the case where a negatively charged toner is used, and reversal development, by which a photoreceptor is negatively charged, is performed will be described. However, the case where a positively charged toner is used and reversal development by which the photoreceptor is positively charged, is performed can also be explained in the same way.

Figure 1:
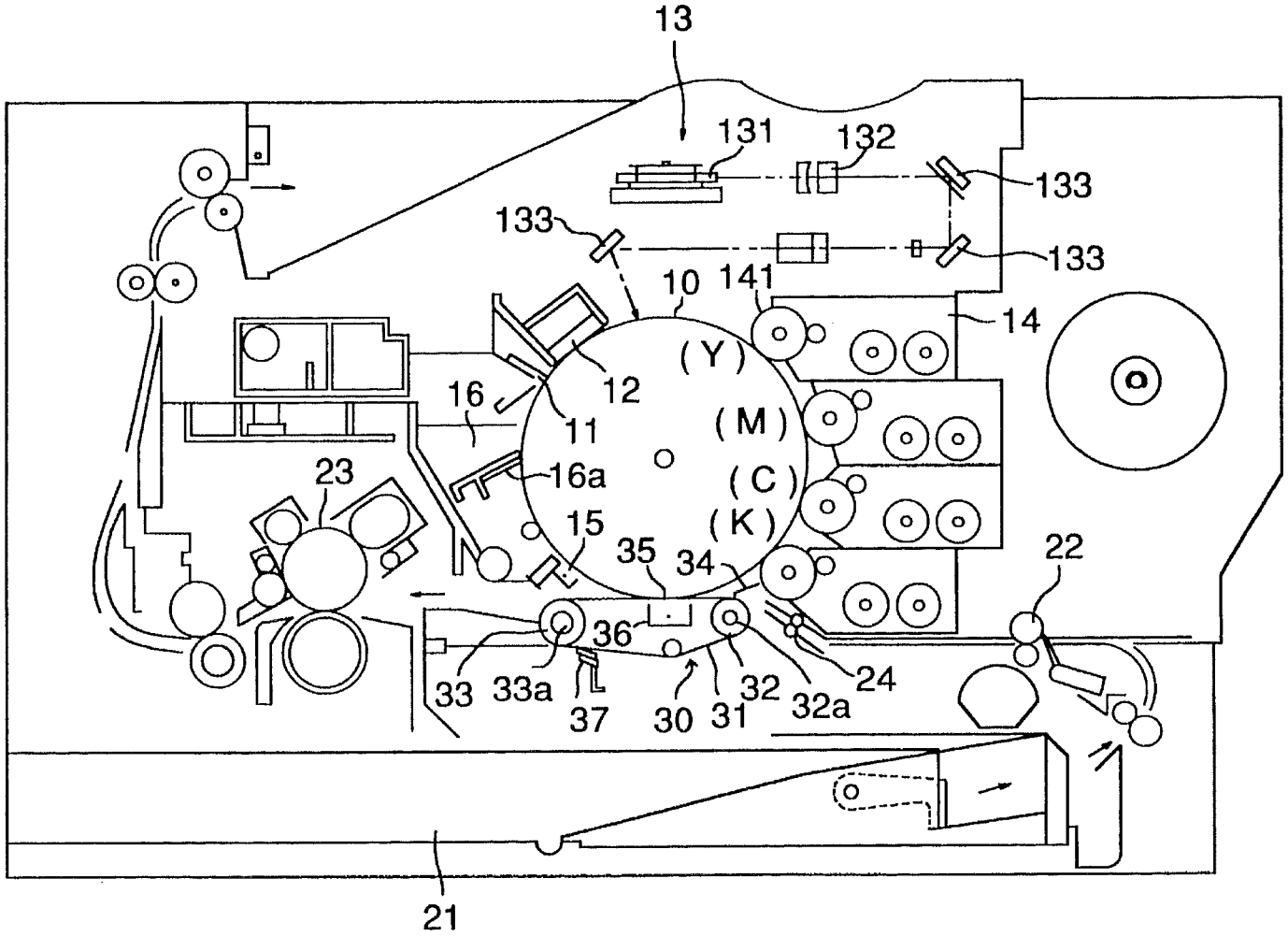
FIG. 1 is a view showing an outline structure of an example of the image forming apparatus of the present invention.

In FIG. 1, numeral 10 is a photoreceptor drum which is an image carrier, and for example, an OPC photoreceptor coated on the photoreceptor drum is grounded, and the drum is rotated clockwise. Numeral 12 is a scorotron charger which is positioned on the photoreceptor drum 10, and by which a uniform potential $V_H$ is impressed upon the surface of the photoreceptor drum 10 by corona discharge using a grid which holds a potential $V_G$ and a corona discharging wire. Before charging by the scorotron charger 12, the surface of the photoreceptor drum 10 is exposed by a PLC (pre-charging exposure apparatus) 11 in which a light emitting diode or the like is used in order to eliminate any remains of a previous printing operation of the photoreceptor, and the surface of the photoreceptor drum 10 is discharged.

Figure 5:
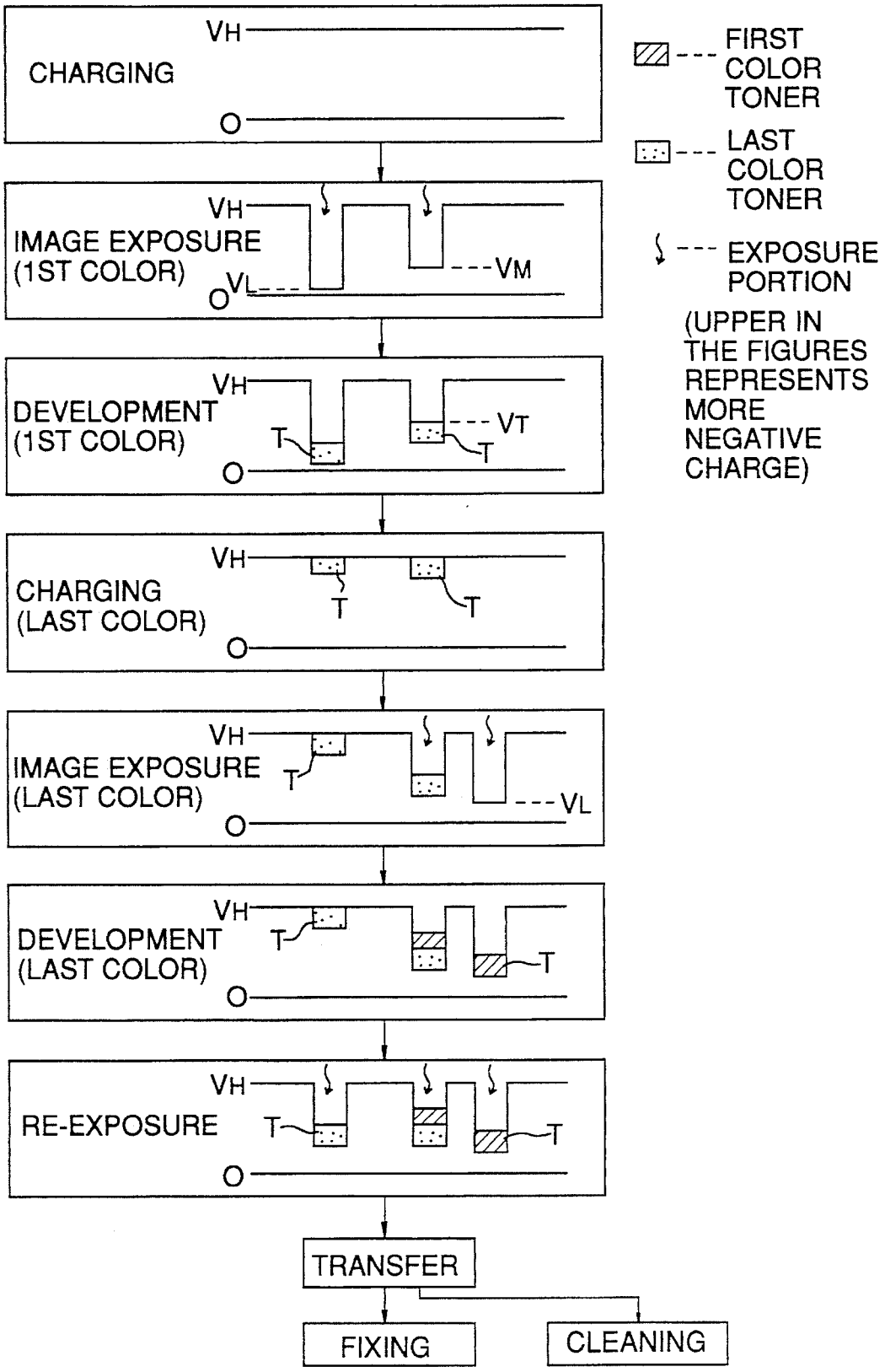
FIG. 5 is a flow chart showing the principle of a multi-color image forming method.
Figure 6:
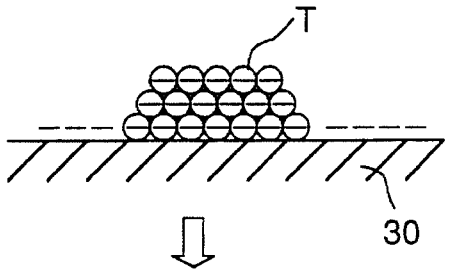
FIGS. 6(*a*), 6(*b*), and 6 (*c*) are views showing a procedure of the offset re-exposure.
Figure 6:
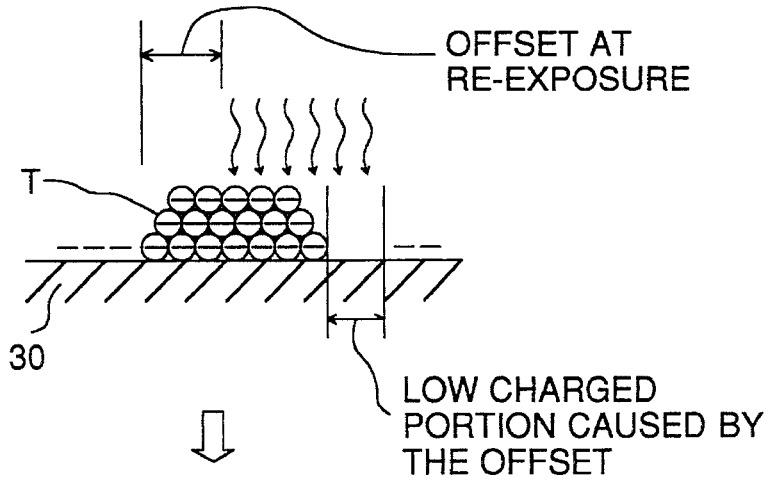
Figure 6:
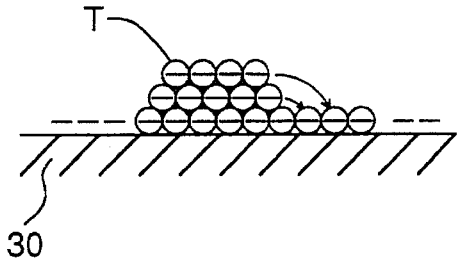

After the photoreceptor has been uniformly charged, the image-exposure is performed according to the image signal by a laser writing apparatus 13 which is an image exposure means. The laser writing apparatus has a laser diode, which is not shown in the drawing, as a laser beam emitting source. The light path of the laser beam is deflected by a plurality of reflection mirrors through a rotating polygonal mirror 131 and an fθ lens 132, and scanning is carried out. A latent image is formed by a rotation of the photoreceptor drum 10 (subsidiary scanning). In this example, the image portion is exposed, and a reversal latent image is formed so that the image portion becomes low potential $V_L$ as shown in FIG. 5.

Developing devices 14 in which developing agents composed of a toner T such as yellow (Y), magenta (M), cyan (C), and black (K) toners, and a carrier are contained respectively, are provided around the photoreceptor drum 10. At first, a first color development is performed by a developing sleeve 141 which has a magnet therein and is rotated. The developing agent is composed of a carrier, which is made of an insulating resin coated around a ferrite core, and a toner T, which is composed of pigments mainly made of a polyester and corresponds to colors, a charging control agent, silica and titanium oxide. The developing agent is controlled to a 300 to 800 μm thickness layer by a layer forming rod on the developing sleeve 141, and conveyed to a developing area.

The gap between the developing sleeve 141 and the photoreceptor drum 10 in the developing area is 0.4 to 1.0 mm which is larger than the layer thickness of the developing agent. AC bias voltage $V_{AC}$ and DC bias voltage $V_{DC}$ are superimposed and impressed between the developing sleeve 141 and the photoreceptor drum 10. $V_{DC}$,$V_H$ and charged toner T have the same polarity as each other. Therefore, toner T, which has separated from the carrier, does not adhere to a portion of $V_H$ which is higher than $V_{DC}$, and adheres to a portion of $V_L$, which is lower than $V_{DC}$, corresponding to the voltage difference between the two, and then the latent image is visualized (reversal development).

After first color visualizing has been completed, the sequence enters into a second color image forming process. The photoreceptor surface is uniformly charged again by the scorotron charger 12, and the latent image according to the second color image data is formed by the image exposing means 13. Discharge by PCL 11 which was performed in the first color image forming process is not conducted because toner T, which is adhered to the first color image portion, is splashed due to sudden lowering of the potential around the image.

Potential $V_H$ is impressed again on the entire surface of the photoreceptor drum 10, and the same latent image as that of the first color image is formed and developed with respect to a portion on which the first color image does not exist. When a portion on which the first color image exists is exposed and developed again, a latent image having the potential $V_T$ is formed by a shading function of toner T which has been adhered to the first color image portion, and an electric charge of the toner itself, and is developed corresponding to the potential difference between $V_{DC}$ and $V_T$. On a portion on which the second color image is superimposed on the first color image, when the first color latent image having the potential of $V_L$ is developed, balance between the first and the second colors is lost. Therefore, sometimes, an exposure amount of the first color is decreased, and an intermediate potential of $V_M$, ( $V_H>V_M>V_L$), is used.

The third, and the fourth color image forming processes are performed in the same way as that of the second color, and the four color toner images are formed on the surface of the photoreceptor drum 10. The photoreceptor drum 10 holding the toner image on the surface thereof is further rotated, and only the image portion is exposed again by the laser beam scanning by the laser writing apparatus 13. The image portion (toner image) is re-exposed by the laser beam so that: electric charges on each image portion are removed by the exposure; transfer repelling is prevented; and excellent transferring can be performed in the next transferring process. At the time, a re-exposure amount is sometimes controlled according to different circumstances. (including a non-controlled case.) Recording sheet P, which is a transfer sheet synchronously fed with the toner image through a sheet feeding mechanism 22 and a timing roller 24 from a sheet feeding cassette 21, is conveyed to a transfer area by a transfer belt apparatus 30, which is a transfer means in which a transfer belt 31 is stretched. Then, a multi-color toner image on the surface of the photoreceptor drum 10 is collectively transferred onto the recording sheet P.

The transfer belt 31 is an endless rubber belt having the thickness of 0.4 to 1.0 mm, and having a resistance of $10^8$ to $10^{14}$ Ω·cm, an FLC layer being formed on the outside of a base made of urethane rubber. A rib is sometimes provided on an end portion of the belt in order to prevent its deflection during rotation.

When a discharging mechanism is provided, a film such as PET, or a high resistance belt on which PET or the like is coated, can also be used for the transfer belt.

A voltage of $V_{PC}$ is impressed upon a shaft 32*a* of an upstream side holding roller 32 of holding rollers 32 and 33 between which the transfer belt 31 is stretched. A grounded conductive brush 34 is provided as a charging means to the recording paper P, at a position with which the shaft 32*a* is contacted through the transfer belt 31. The recording sheet P conveyed from the sheet feeding means enters between the brush 34 and the transfer belt 31, electric charges are given to the recording sheet P from the brush 34, and an attracting force is generated between the recording sheet P and the transfer belt 31. After that, the recording sheet P enters into a nipping portion (transfer area) formed between the photoreceptor drum 10 and the transfer belt 31, and a transfer electric field is given to the recording sheet P by a corona discharger 36, or a bias roller in place of the corona discharger 36, from the rear surface of the transfer belt 31. Due to the foregoing, a multi-color toner image is transferred onto the recording sheet P.

The recording sheet P, on which the transferred multi-color toner image is held, is discharged by the method of AC corona discharge, in which the counter electrode is a shaft 33*a* of the downstream side holding roller 33 by which the transfer belt 31 is suspended. After or during AC corona discharging, the recording sheet P is separated from the transfer belt 31. Numeral 37 is a cleaning blade which removes toner adhered to the rotating transfer belt 31. The transfer belt 31 of the transfer belt apparatus 30 is rotated around the shaft 33*a* of holding roller 33 at the downstream side of the belt, and separated from the photoreceptor drum 10 while the multi-color toner image is being formed or the re-exposure is being carried out.

The recording sheet P holding thereon a multi-color image separated from the transfer belt apparatus 30, is conveyed to a fixing apparatus 23 composed of two pressure contact rollers having a heater in the inside of at least one of the rollers or at an outside close position, and the adhered toner is melted and fixed on the recording sheet P when the recording sheet P is heated and pressurized between two rollers. After that, the recording sheet P is delivered outside the image forming apparatus.

After transferring, residual toner remained on the photoreceptor drum 10 is discharged by the discharger 15 using the AC corona discharger. After that, the toner arrives at a cleaning apparatus 16, which is a cleaning means, and is scraped down into the cleaning apparatus 16 by a cleaning blade 16*a*, which is made of a rubber material and is contacted with the photoreceptor. Then, the toner is delivered out of the cleaning apparatus 16 by a screw, or stored therein.

The photoreceptor drum 10, from which the residual toner has been removed by the cleaning apparatus 16, is exposed by the PLC 11, and after that, it is uniformly charged by the scorotron charger 12 and enters into the next image forming cycle. While the multi-color image is being formed and the re-exposure is being carried out, the cleaning blade 16*a* is separated from the surface of the photoreceptor, and AC discharge by the discharger 15 is not carried out.

Figure 2:
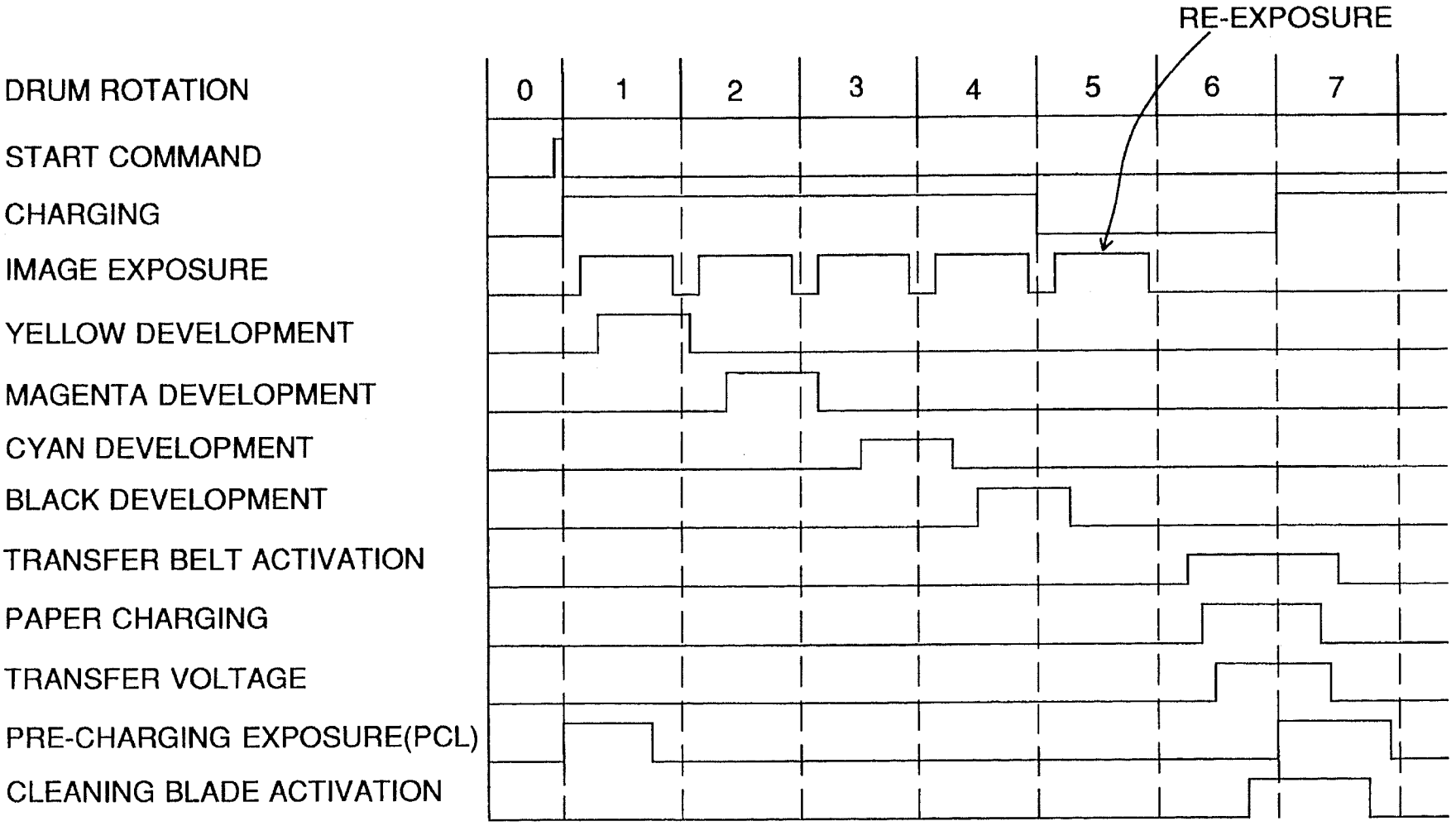
FIG. 2 is a time chart showing an operation in each section of the image forming apparatus according to the first embodiment of the present invention.

In the image forming apparatus according to the first example of the present invention, the transfer belt apparatus 30 and the cleaning blade 16*a* are pressure-contacted with the photoreceptor drum 10 after the re-exposure has been completed as shown in a timing chart in FIG. 2. Due to the foregoing, a load of the photoreceptor drum 10 is not varied, and a constant traveling speed can be held, so that the re-exposure can be carried out in the correct position.

Further, in the first example, both the transfer belt apparatus 30 and the cleaning blade 16*a* are pressure-contacted after the re-exposure. However, even when either one of the transfer belt apparatus 30 and the cleaning blade 16 is pressure-contacted after the re-exposure, the variation of the traveling speed of the photoreceptor drum 10 is small, and therefore, the correct re-exposure can be carried out. Of course, better results can be expected when both of them are pressure-contacted.

Because the image is formed by the foregoing processes in the image forming apparatus according to the first example of the present invention, the four color image is formed by six rotations of the photoreceptor drum 10.

In the foregoing, the pressure-contact of the transfer belt apparatus and the cleaning blade has been explained. However, when the pressure-contact operation of a member, such as a smoothing member, with the photoreceptor is released after re-exposure as described, unsatisfactory copying such as a color offset can be prevented.

In the first example of the present invention, at least one of the transfer belt apparatus and cleaning blade is pressure-contacted with the photoreceptor drum (image carrier) after the re-exposure has been completed. Therefore, there is no variation in the traveling speed of the photoreceptor drum during the re-exposure, and the re-exposure is carried out in the correct position. Accordingly, a portion other than the image portion is not re-exposed, and a portion near the image portion becomes low potential, so that the toner is not splashed near the image portion. Due to this, the first example of the present invention can provide an image forming apparatus by which an excellent image having high resolution and no color offset can be obtained.

Figure 3:
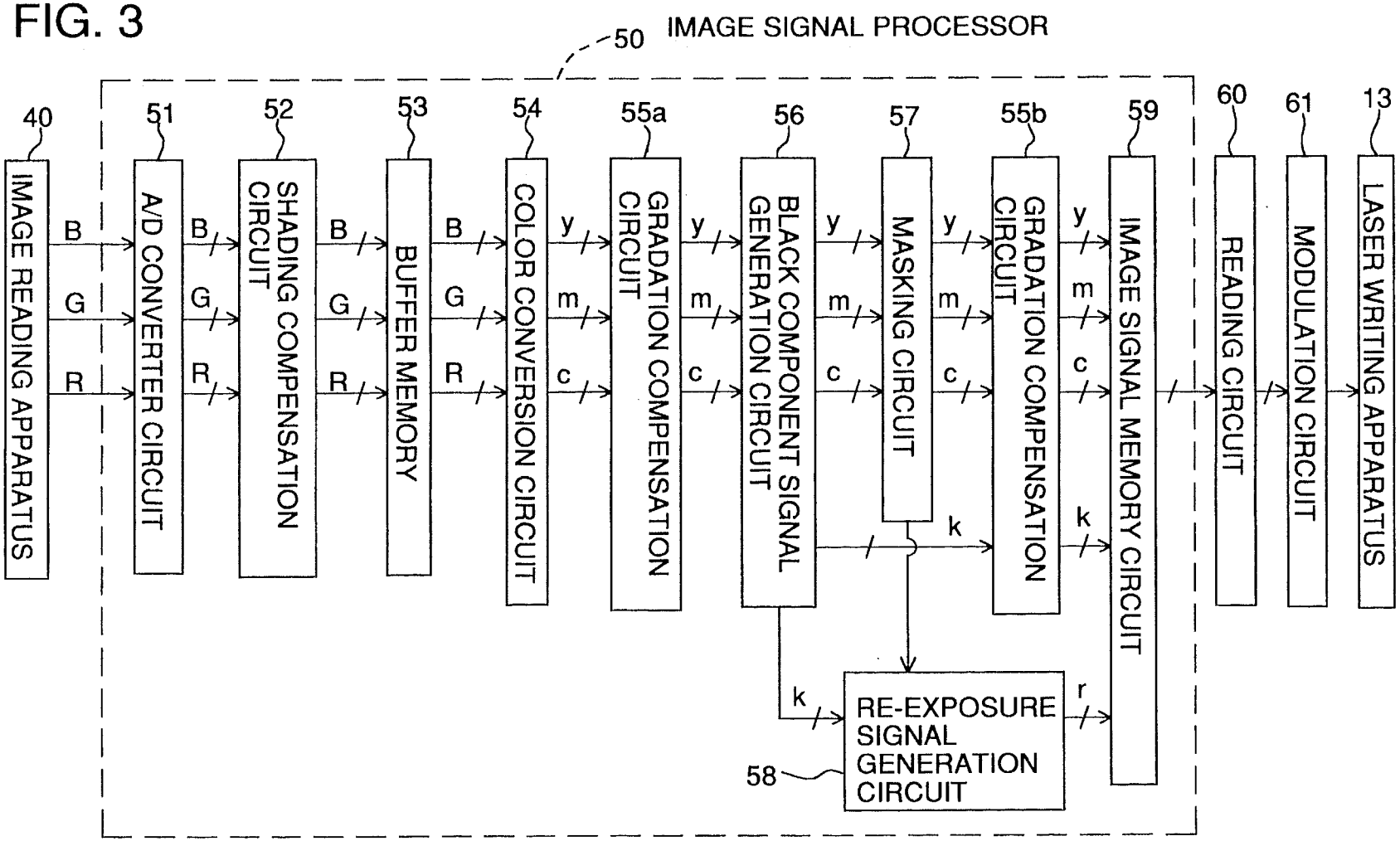
FIG. 3 is a block diagram showing an example of an image signal processing section of the image forming apparatus according to the second embodiment of the present invention.

Next, the second example of the present invention will be described as follows. Referring to FIG. 3, the example will be explained on the supposition that an image signal is inputted from, for example, an image reading apparatus which is not shown in the drawings.

Analog signals of image color signals, B (blue), G (green), and R (red), of an original document are inputted from an image reading apparatus 40 into an image signal processor 50. These signals are A/D converted by an A/D converter circuit 51. Then, distortion of the signals caused by an optical system is removed by a shading compensation circuit 52. After that, the signals are temporarily inputted into a buffer memory 53, and make B, G, and R signals correspond to the same image position. Next, the B, G, and R signals outputted from the buffer memory 53 are respectively color-converted by a color conversion circuit 54 into Y (yellow), M (magenta), and C (cyan) and become respectively y, m, and c signals. These signals are gradation compensated in a gradation compensation circuit 55*a*, and after that a black component signal is generated from each y, m, and c data in a black component signal generation circuit 56, so that a digital signal k of the black component is generated. In this process, the y, m, and c signals are color corrected in a masking circuit 57, and gradation compensated again together with the k signal in a gradation compensation circuit 55*b*. On the other hand, in a re-exposure signal generation circuit 58 into which the y, m, and c signals are inputted from the masking circuit 57, and the k signal is inputted from the black component signal generation circuit 56, a re-exposure signal r is generated by which the image (toner image) portion except the black component image portion is re-exposed, which is the final image exposing operation in this example. The re-exposure signal r is inputted into an image signal memory circuit 59 together with the y, m, c, and k signals. Each image signal is read out by a reading circuit 60 from the image signal memory circuit 59 according to the image exposure sequence, pulse width-modulated, for example, in a modulation circuit 61, and sent to the laser writing apparatus 13. After this, by the same procedure of the first example, a toner image consisting of multiple color toner layers is formed on the photoreceptor drum.

Figure 4:
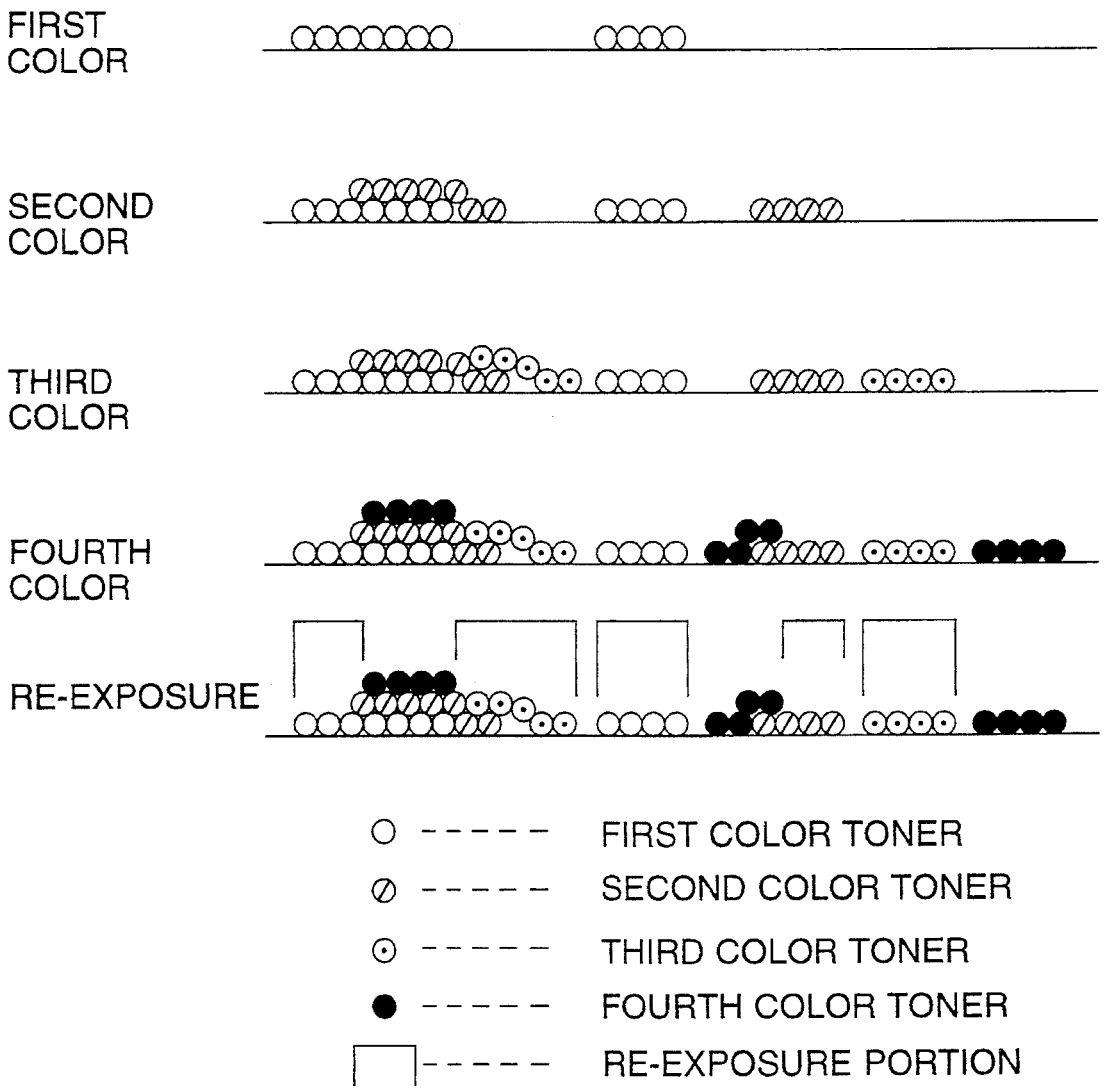
FIG. 4 is a view showing a toner image forming sequence and a re-exposure portion.

According to the second example, the photoreceptor drum 10 holding the toner image on the surface thereof is further rotated without being re-charged. Only image portions other than the last color toner image are re-exposed by laser scanning according to the r signal of the laser writing apparatus 13. A re-exposure amount at the time can be controlled by an environmental difference. (the case without any control is also possible.) FIG. 4 is a view showing a sequence in which each color image (toner image) is formed, and a re-exposure portion. The re-exposure onto the image portion by a laser beam eliminates electric charges on each color toner image portion other than the last color toner image. Also, the electric charge on the last color toner image is already lowered when the image exposure has been carried before the re-exposure. Therefore this example prevents transfer repelling, so that excellent transferring can be carried out in the next transfer process.

In this example, the final image is not re-charged, and therefore, it is not necessary to eliminate electric charges by the re-exposure. Accordingly, redundant processes such as the re-exposure and re-charging are not necessary, and therefore, better transfer can be performed.

In the second example of the present invention, as described in the foregoing, re-charging is not carried out after toner images have been superimposed, and after only the image portion except the finally formed image (toner image) has been re-exposed, toner images are transferred. Accordingly, the area on which the re-exposure is carried out is smaller, and a generation ratio of toner splashing is decreased. Further, potentials of the image portions are equal during transferring, so that the present invention can provide an image forming apparatus by which stable and highly efficient transfer can be carried out.

What is claimed is:

1. An image forming method comprising;

(a) charging a photoreceptor to form a charged photoreceptor;

(b) imagewise exposing said charged photoreceptor to form a latent image on said photoreceptor;

(c) developing said latent image with a toner to form a toner image;

(d) sequentially repeating a cycle comprising said charging step, said imagewise exposing step, and said developing step to form a registered plurality of toner images, each of said plurality of toner images being formed with a different color toner, on said photoreceptor;

(e) after a final developing step, re-exposing only the portion of said photoreceptor on which said plurality of registered toner images have been formed; and (f) after said re-exposing, transferring said plurality of registered toner images onto a recording sheet, and cleaning residual toner from said photoreceptor by contact with a cleaning device.

2. The method of claim 1 wherein at least one of said developing step in said sequentially repeating cycle is conducted using a method of non-contact developing.

3. An image forming method comprising;

(a) charging a photoreceptor to form a charged photoreceptor;

(b) imagewise exposing said charged photoreceptor to form a latent image on said photoreceptor;

(c) developing said latent image with a toner to form a toner image;

(d) sequentially repeating a cycle comprising said charging, imagewise exposing, and developing to form a registered plurality of toner images, each of said plurality of toner images being formed with a different color toner, on said photoreceptor;

(e) after a last developing step, re-exposing only a portion of said photoreceptor on which said plurality of registered toner images, exclusive of the portion on which a toner image formed in said last developing step have been formed; and (f) after said re-exposing step, transferring said plurality of registered toner images onto a recording sheet.

4. The method of claim 3 wherein at least one of said developing step in the sequentially repeated cycle comprises a non-contact developing step.

5. The method of claim 3 wherein said plurality of toner images are yellow, magenta, cyan, and black toner images, and said black toner image is formed on said photoreceptor by the final developing step.

* * * * *